US007617747B2

(12) United States Patent
Richert et al.

(10) Patent No.: US 7,617,747 B2
(45) Date of Patent: Nov. 17, 2009

(54) METHODS OF MANUFACTURING ROTARY DRAG BITS INCLUDING A CENTRAL REGION HAVING A PLURALITY OF CUTTING STRUCTURES

(75) Inventors: Volker Richert, Celle/Gross-Hehlen (DE); David W. Watson, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/844,257

(22) Filed: Aug. 23, 2007

(65) Prior Publication Data

US 2007/0284153 A1 Dec. 13, 2007

Related U.S. Application Data

(62) Division of application No. 11/044,745, filed on Jan. 26, 2005, now Pat. No. 7,278,499.

(51) Int. Cl.
*B21K 5/04* (2006.01)
*E21B 10/00* (2006.01)

(52) U.S. Cl. ..... 76/108.2; 175/348

(58) Field of Classification Search ..... 76/108.1, 76/108.2, 108.4; 175/348, 400, 405.1, 434
See application file for complete search history.

(56) References Cited

U.S. PATENT DOCUMENTS 2,264,617 A 12/1941 Carpenter et al.
2,381,415 A 8/1945 Williams, Jr.
2,493,178 A 1/1950 Williams, Jr.
2,708,105 A 5/1955 Williams, Jr.
2,838,284 A 6/1958 Austin
2,954,211 A * 9/1960 Penrod ..... 175/380
3,599,736 A 8/1971 Thompson
3,727,704 A 4/1973 Abplanalp
3,951,220 A 4/1976 Phillips, Jr. et al.
4,073,354 A * 2/1978 Rowley et al. ..... 175/430
4,176,723 A 12/1979 Arceneaux
4,351,401 A * 9/1982 Fielder ..... 175/428
4,423,646 A * 1/1984 Bernhardt ..... 76/108.1
4,550,790 A 11/1985 Link (Continued)

OTHER PUBLICATIONS

PCT International Search Report for Application No. PCT/US2006/002734, dated May 22, 2006.

*Primary Examiner*—Hwei-Siu C Payer
(74) *Attorney, Agent, or Firm*—TraskBritt

(57) ABSTRACT

A rotary drag bit including an inverted cone geometry proximate the longitudinal axis thereof is disclosed. The inverted cone region may include a central region, the central region including a plurality of cutting structures affixed thereto and arranged along at least one spiral path. The at least one spiral path may encircle its center of revolution at least once within the inverted cone region. A cone region displacement and a method for manufacturing a rotary drag bit therewith are disclosed. At least one groove may be formed within the cone region displacement along a respective at least one spiral path, the at least one spiral path encircling its center of revolution at least once. A plurality of cutting structures may be placed within the at least one groove and the cone region displacement may be placed within a mold for filling with an infiltratable powder and infiltrating with a hardenable infiltrant.

12 Claims, 10 Drawing Sheets

U.S. PATENT DOCUMENTS

| | | | | | |
|---|---|---|---|---|---|
| 4,646,857 | A | | 3/1987 | Thompson | |
| 4,776,411 | A | | 10/1988 | Jones | |
| 4,884,477 | A | * | 12/1989 | Smith et al. | 76/108.2 |
| 5,000,273 | A | * | 3/1991 | Horton et al. | 175/433 |
| 5,131,478 | A | | 7/1992 | Brett et al. | |
| 5,265,685 | A | * | 11/1993 | Keith et al. | 175/431 |
| 5,373,907 | A | * | 12/1994 | Weaver | 175/426 |
| 5,595,252 | A | | 1/1997 | O'Hanlon | |
| 6,089,123 | A | * | 7/2000 | Chow et al. | 76/108.2 |
| 6,283,233 | B1 | | 9/2001 | Lamine et al. | |
| 6,287,360 | B1 | | 9/2001 | Kembaiyan et al. | |
| 6,353,771 | B1 | * | 3/2002 | Southland | 700/197 |
| 6,454,030 | B1 | | 9/2002 | Findley et al. | |
| 6,458,471 | B2 | | 10/2002 | Lovato et al. | |
| 6,510,906 | B1 | | 1/2003 | Richert et al. | |
| 7,278,499 | B2 | * | 10/2007 | Richert et al. | 175/348 |

* cited by examiner

METHODS OF MANUFACTURING ROTARY DRAG BITS INCLUDING A CENTRAL REGION HAVING A PLURALITY OF CUTTING STRUCTURES

CROSS-REFERENCE TO RELATED APPLICATION

This application is a divisional of application Ser. No. 11/044,745, filed Jan. 26, 2005, now U.S. Pat. No. 7,278,499, issued Oct. 9, 2007. The disclosure of the previously referenced U.S. patent application is hereby incorporated by reference in its entirety.

BACKGROUND OF THE INVENTION

1. Field of the Invention

The present invention relates generally to fixed cutter or drag type bits for drilling subterranean formations and, more specifically, to drag bits for drilling relatively hard, abrasive, or hard and abrasive rock formations.

2. State of the Art

So-called "impregnated" drag bits may be used conventionally for drilling relatively hard, abrasive, or hard and abrasive rock formations, such as sandstones. Impregnated drag bits may typically employ a cutting face composed of diamond impregnated matrix, which may comprise superabrasive cutting particles, such as natural or synthetic diamond grit, dispersed within a matrix of wear resistant material. For example, the wear resistant matrix may typically comprise a tungsten carbide powder infiltrated with a copper-based binder. Thus, the blades or bit face itself may comprise diamond particles which are used to engage the formation and thus drill thereinto. Accordingly, during use of an impregnated drag bit, the embedded diamond particles and the matrix material in which they are dispersed may wear and as worn cutting particles are lost, and new cutting particles may be exposed. Of course, impregnated drag bits may include different types of diamond material, such as natural diamonds, synthetic diamond, and thermally stable diamond material.

Similarly, so-called BALLASET® drag bits employ a cutting face primarily composed of synthetic thermally stable diamond cutting structures that protrude from the matrix material in which they are disposed. Thermally stable diamond, as known in the art, generally comprises polycrystalline diamond sintered material that initially contains a catalyzing material, such as cobalt, which is later removed, as by an acid leaching process. Removal of the catalyst is believed to reduce "back conversion" of sintered polycrystalline diamond to graphite by dissolution within the catalyst at elevated temperatures. Since BALLASET® drag bits may employ diamond cutting structures that extend from the surface of the blades or profile, during use of a BALLASET® drag bit, abrasive wear may occur upon the thermally stable cutting structures.

Conventionally, impregnated or BALLASET® drag bits may be fabricated by similar processes. Particularly, a mold is machined and prepared, often at least partially by hand, to form a shape that is complementary to the shape of the desired drag bit geometry. Diamond cutting structures may be placed within the mold or upon a surface thereof and may comprise natural, synthetic, or thermally stable diamond material. Further, as known in the art, displacements, which may comprise resin-coated sand or graphite, may be formed by machining, grinding, or as otherwise known in the art and placed into the mold to form junk slots, fluid communication ports, or other topographical features of the rotary drag bit. The mold may be filled with a powder or particulate which is preferably erosion or abrasion resistant, such as, for instance, tungsten carbide or an equivalent material. A steel support structure, known as a "blank" in the art, may be disposed at least partially within the mold prior to filling with powder or particulate. The mold may then be placed in a furnace where a suitable copper-based binder or other metal alloy binder is melted and infiltrated into the particulate, so as to form, upon cooling, a body of solid infiltrated matrix material in a complementary shape of the mold, and having thermally stable or natural diamond particles embedded in its outer surface. The blank may also be affixed within the hardened infiltrant and may be sized and configured for post-furnacing machining so as to attach the blank to a hardened, threaded, steel shank, as by welding. This method of construction of infiltrated drag bits is well known in the art.

Alternatively, in the case of an impregnated drag bit, a cutting structure including diamond may be preformed, such as a segment or post, by hot isostatic pressure infiltration or other infiltration process, and subsequently attached to the drag bit body by brazing. In a further alternative method of manufacture, preformed cutting structures may be placed within a mold and affixed to the drag bit by an infiltration process, such as the one described above.

It is well known in the art that rotary drag bits may include a so-called inverted cone region, which refers generally to an indentation formed in the face of the rotary drag bit proximate the longitudinal axis thereof in a direction generally opposing the direction of drilling. It is also known in the art that the drilling fluid ports may extend through the interior of the body of the drag bit and exit the surface of the face of a drag bit proximate the longitudinal axis, within the cone region or as otherwise desired.

Regarding the inverted cone region, conventional approaches to manufacturing usually include forming a cone displacement of a complementary geometry in relation to the desired geometry of at least a portion of the inverted cone region of the rotary drag bit and placing the cone displacement within a mold. A conventional cone displacement will typically comprise a substantially conical body and include recesses that follow relatively straight radial paths, the paths specifically configured for placement of cutting structures, such as natural diamonds or synthetic diamond material, the diamond material to become imbedded within the inverted cone region upon infiltration. Thus, the cone displacement may be positioned substantially centrally at the longitudinal bottom of a rotary drag bit mold and cutting structures, such as natural diamonds or thermally stable diamonds, may be placed upon the surface of the displacement. As a further consideration, a fluid bore displacement, typically comprising resin-coated sand, may mate to the cone displacement along at least a portion thereof to form one or more fluid ports exiting to the face or surface of the rotary drag bit within the inverted cone region.

As may be appreciated, it is desirable that the circumferential position of the radially extending recesses, which are configured for placement of cutting structures, such as diamonds, of the cone displacement are preferably configured so as to not intersect with the mating regions of the fluid bore displacement, because such interference may require that the diamond cutting structures be repositioned. For instance, if the recesses do overlap with mating regions of the fluid bore displacement, modifications may be required to ensure a desired amount of diamond cutting material is included within a central region of the rotary drag bit. Such modifications may be undesirably inconvenient and costly.

In one example of a conventional rotary drag bit design, U.S. Pat. No. 3,599,736 to Thompson discloses a rotary drag bit including a plurality of abrasive particles dispersed along generally radially extending blades. In addition, the rotary drag bit includes an inverted cone region having a surface from which drilling fluid apertures exit. However, as shown in FIG. 2 of U.S. Pat. No. 3,599,736 to Thompson, the intersection of fluid ports 17 with the cutting structures 27 disposed on lands 18 (blades) may require a customized and relatively complicated cone displacement or mold and a mating fluid bore displacement, both of which may be dependent on one another and, therefore, difficult to modify or adapt to different sizes or configurations.

Another conventional rotary drag bit is disclosed in U.S. Pat. No. 2,838,284 to Austin, which includes lands 20 (blades) that spiral generally from the longitudinal axis thereof. Diamond cutting elements 16 are disposed on the lands 20. Also, U.S. Pat. No. 4,550,790 to Link discloses a rotary drag bit having spiral lands 40. Further, U.S. Pat. No. 4,176,723 to Arceneaux discloses a diamond drag bit wherein the diamonds are arranged in a plurality of individual rows, wherein each row extends along a slight spiral from the gage radially inwardly toward the center of the drag bit. Finally, U.S. Pat. No. 3,951,220 to Phillips, Jr. discloses a drag bit which includes an eccentric fluid port and spiral blades that carry carbide buttons.

Since molds used to fabricate rotary drag bits are time consuming and labor intensive to fabricate, improved methods of manufacture may be desired which afford greater flexibility in manufacturing. Although the present invention may be particularly applicable to impregnated drag bits, it may also be applicable to rotary drag bits, including larger natural or synthetic cutting structures that are set in the outer surface thereof, such as BALLASET® drag bits or polycrystalline diamond compact (PDC) drag bits. Thus, it would be desirable for a rotary drag bit to include an inverted cone region that is simplified from a manufacturing standpoint. Also, it would be desirable for a rotary drag bit to include improved drilling structures.

BRIEF SUMMARY OF THE INVENTION

The present invention comprises a rotary drag bit employing an inverted cone geometry wherein the inverted cone region includes a central region proximate the longitudinal axis of the rotary drag bit that includes cutting structures.

In one embodiment, a rotary drag bit for drilling subterranean formations may include a bit body having a face extending from a longitudinal axis to a gage and at least one aperture for communicating drilling fluid from the interior of the bit body to the face thereof. In addition, the rotary drag bit may include a plurality of blades comprising an abrasive material configured for drilling a subterranean formation, the blades extending generally radially outwardly toward the gage. Furthermore, the rotary drag bit may include an inverted cone region including a central region thereof radially proximate the longitudinal axis, the central region including a plurality of cutting structures affixed thereto and arranged about a center of revolution of at least one spiral path. The at least one spiral path may encircle its center of revolution at least once within the inverted cone region. In one embodiment, the at least one spiral path may encircle the longitudinal axis of the drill bit at least once within the inverted cone region.

Rotary drag bits of the present invention may comprise at least one of natural diamonds and synthetic diamonds. For instance, a rotary drag bit of the present invention may comprise an impregnated rotary drag bit or a rotary drag bit that includes cutting structures which protrude from the blades thereof, such as a BALLASET® type rotary drag bit. Alternatively or additionally, the blades may include one or more polycrystalline diamond cutting elements disposed thereon. As a further example, a rotary drag bit of the present invention may comprise blades, wherein each of the blades includes at least one substantially radially extending row of cutting structures.

Methods of manufacture of a drag bit are also disclosed. Specifically, a mold may be provided that is sized, shaped, and configured to define topographical features of a rotary drag bit to be fabricated. Also, a cone region displacement, including at least one groove formed therein, may be formed and positioned within the mold. Further, a plurality of cutting structures may be placed within the at least one groove and the mold may be filled with an infiltratable powder and infiltrated by a hardenable infiltrant. In one embodiment, the at least one groove may be formed within a cone region displacement along a spiral path extending in the direction of the longitudinal axis of the cone region displacement, which may encircle its center of revolution at least once.

The present invention also relates to a displacement for forming at least an inverted cone region of a rotary drag bit, during manufacture thereof. For instance, a cone region displacement of the present invention may comprise a body sized and shaped with an outer surface which is generally complementary to a desired size and shape of the inverted cone region of the rotary drag bit for forming therewith. Further, at least one groove may be formed into the body along at least one spiral path to encircle a center of revolution thereof at least once. Of course, a plurality of cutting structures may be placed at least partially within the at least one groove of the cone region displacement.

BRIEF DESCRIPTION OF THE SEVERAL VIEWS OF TM DRAWINGS

DETAILED DESCRIPTION OF THE INVENTION

Figure 1A:
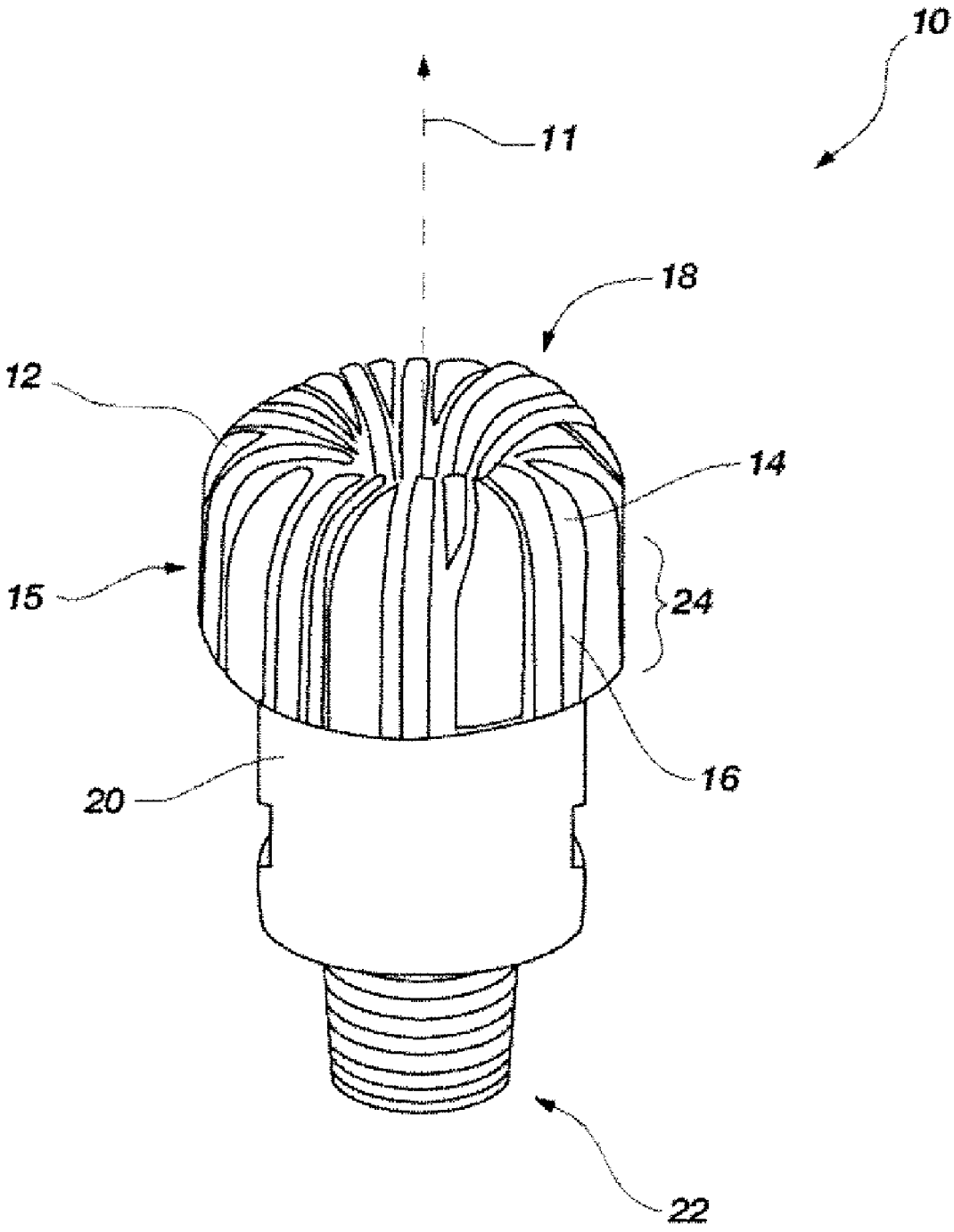
FIG. 1A is a perspective view of an impregnated rotary drag bit of the present invention.
Figure 1B:
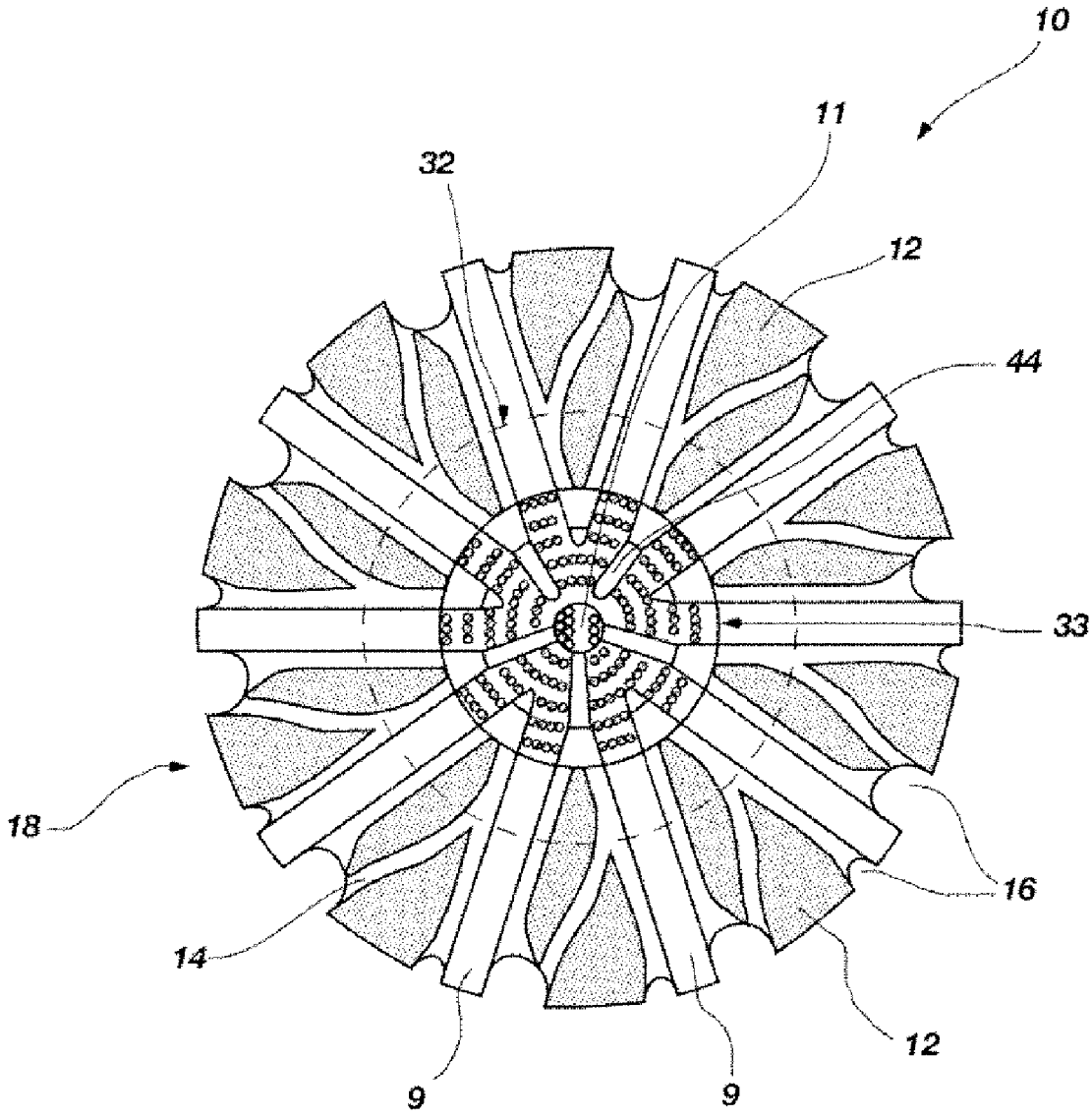
FIG. 1B is a top elevation view of the rotary drag bit shown in FIG. 3A.

Referring now to FIGS. 1A and 1B of the drawings, a first embodiment of a rotary drag bit 10 of the present invention is depicted in perspective and top elevation views, in relation to longitudinal axis 11, respectively. Rotary drag bit 10 includes a crown 15 having a bit face 18 for drilling into a subterranean formation. Bit face 18 may include an inverted cone region 32 as discussed in greater detail hereinbelow. The crown 15 may be connected to a longitudinally extending body 20 and further to a connection structure 22, such as a threaded connection for attachment to a drill string (not shown) as known in the art. A plurality of blades 9 and 12 may extend generally radially outwardly to gage regions 24 defining junk slots 16 circumferentially therebetween. Fluid courses 14 may extend generally radially inwardly from junk slots 16 and between blades 9 and 12. In addition, selected fluid courses 14 may extend to fluid apertures 44, which may be configured to communicate drilling fluid from the interior of the rotary drag bit 10 to the bit face 18 thereof.

The term "blades" is known in relation to drag bits, to mean raised structures that extend or protrude from the bit face of a drag bit which may be configured for carrying cutting elements. In the case of an impregnated drag bit, "blades" also refers to raised structures extending or protruding from the profile of the bit, but such a blade may itself serve as the cutting structure, since diamond particles may be interspersed therein. Also, in other types of drag bits, such as BALLASET® type drag bits or drag bits carrying polycrystalline diamond compact (PDC) cutting elements, the cutting structures may protrude from and may be carried by blades. Therefore, as used herein, the term "blades" refers to both impregnated-type blades as well as blades that carry cutting structures that protrude therefrom.

Blades 9 and 12 of rotary drag bit 10 may comprise different materials, as depicted in FIG. 1B. For instance, blades 9 may comprise an impregnated material that is formed by way of a relatively high pressure infiltration process, as known in the art, and may include a relatively fine tungsten carbide material that is intended to wear away from the diamond particles interspersed therein, exposing unworn diamonds therein. Blades 12 may, for example, comprise a relatively more abrasion resistant tungsten carbide material and may be formed by way of a relatively low pressure infiltration process, as known in the art. Such a configuration may provide flexibility in design and ability to tailor the performance characteristics of blades 9 and 12 to different expected formations and drilling conditions. FIG. 1B also depicts central region 33, which is shown and described in greater detail in relation to FIGS. 1C and 1D.

Figure 1C:
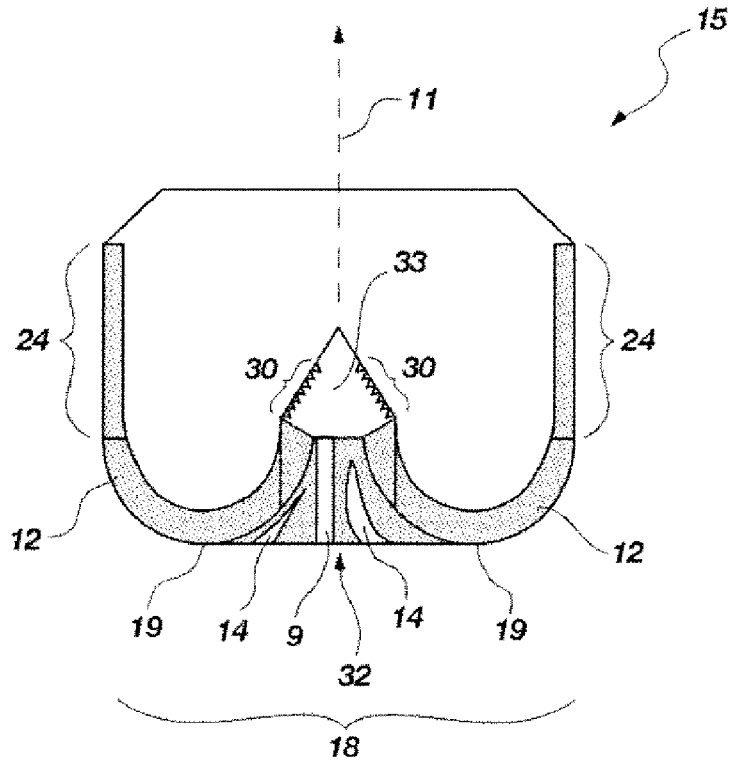
FIG. 1C is a partial side cross-sectional schematic view of the crown of the rotary drag bit shown in FIGS. 1A and 1B.

FIG. 1C shows a partial cross-sectional schematic side view of the crown 15 of rotary drag bit 10 shown in FIGS. 1A and 1B, wherein the crown 15 is oriented as it would be for drilling into a formation. More specifically, FIG. 1C illustrates that the gage regions 24 of rotary drag bit 10 may comprise different abrasive and matrix constituents than do blades 9, 12, or both. In addition, blades 9, 12 may include one or more polycrystalline diamond cutting elements (not shown) affixed thereto, without limitation. Polycrystalline diamond cutting elements, as known in the art, may generally comprise a sintered polycrystalline diamond layer or table affixed to a supporting substrate, which usually comprises tungsten carbide. Also, FIG. 1C depicts the inverted cone region 32 of rotary drag bit 10. Inverted cone region 32 of rotary drag bit 10 refers to the area generally radially inward from lowermost longitudinal extent 19 of blades 9 or 12. It should be noted that the term "inverted cone" is a term of art and does not imply any specific geometrical features other than the presence of an indentation or depression formed into the face 18 of rotary drag bit 10 generally disposed about the longitudinal axis, the indentation formed in the opposite direction to the direction of drilling. Inverted cone region 32 of rotary drag bit 10 is generally shaped, as shown in FIG. 1C as a partially arcuate indentation formed about the longitudinal axis 11 of the rotary drag bit 10.

Further, central region 33 illustrates a portion of rotary drag bit 10, which during drilling, may be configured to accept a core of the formation being drilled. Accordingly, central region 33 of rotary drag bit 10 may include a plurality of cutting structures 30 arranged on the surface thereof along at least one spiral path. "Spiral," as used herein, refers to the path of a point that moves circumferentially around a central point or center of revolution while generally radially receding from or preceding toward the central point or center of revolution. Therefore, in an increasing radial direction, each radially adjacent cutting structure 30 arranged along the spiral path may be also generally positioned at an increased circumferential position thereon.

Cutting structures 30 may comprise natural diamond, synthetic diamond, or thermally stable synthetic diamond, or combinations thereof. In addition, cutting structures 30 may be circular, spherical, triangular, rectangular, semi-circular in shape or shaped as otherwise desired or known in the art. For example, GEOSET® thermally stable diamonds, available from the General Electric Company of New York, N.Y., may be used within a drag bit of the present invention. Furthermore, although cutting structures 30 are illustrated as being substantially similar in size and configuration, the present invention is not so limited. Rather, cutting structures 30 disposed within central region 33 according to the present invention may be sized differently or, alternatively, may be substantially identically sized. Similarly, cutting structures 30 disposed within central region 33 according to the present invention may be shaped differently or, alternatively, may be substantially identically shaped.

Figure 1D:
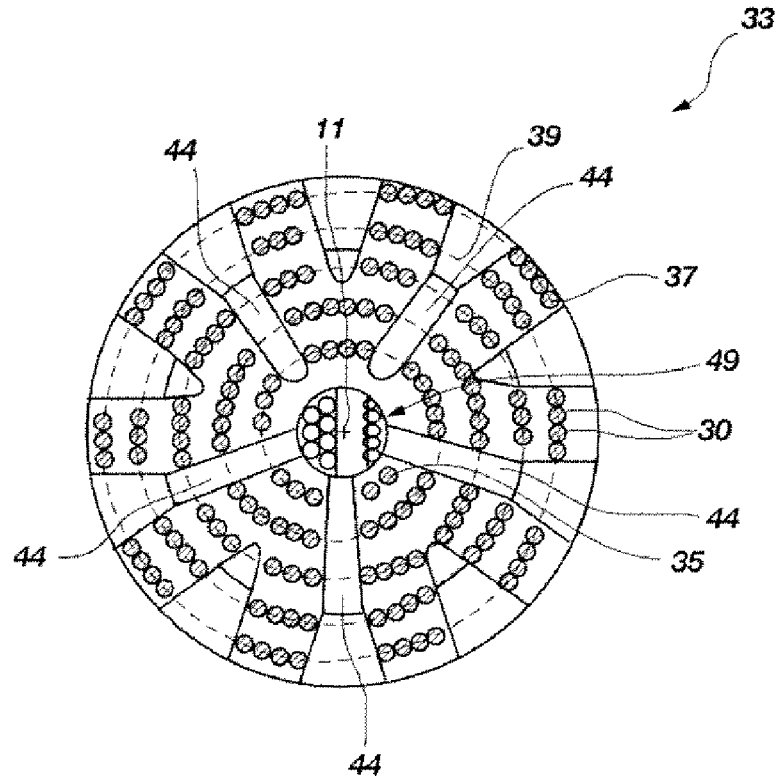
FIG. 1D is an enlarged top elevation view of the central region shown in FIG. 1B.

More specifically, as shown in FIG. 1D, the plurality of cutting structures 30 may be disposed along spiral path 39, spiral path 39 extending about longitudinal axis 11, in a clockwise circumferential direction, between beginning point 35 and end point 37, However, since fluid apertures 44 prevent placement of cutting structures 30 therein, the spiral path 39 continues therethrough, and placement of cutting structures 30 continues on the portions of the central region 33 that do not comprise fluid apertures 44.

As shown in FIG. 1D, each radially and circumferentially adjacent cutting structure 30 substantially abuts against at least another radially and circumferentially adjacent cutting structure. However, the present invention contemplates that the cutting structures 30 may be placed upon spiral path 39 according to substantially constant spacing, variable spacing, or a combination thereof, or as otherwise desired.

In addition, although spiral path 39 is shown as having a mathematical relationship between the circumferential position along the spiral path in relation to a starting point and the radial position, the present invention is not so limited.

More generally, one example of a spiral path which is defined by a mathematical relationship between the radial position and the angle of rotation (circumferential position) is termed an Archimedean spiral.

For example, the mathematical relationship defining an Archimedean spiral is:

$$r=A\theta$$

wherein r is the radial position;

wherein A is a constant of proportionality; and wherein θ is the angle of rotation about a point or axis.

As a further example of a common spiral which is defined by a mathematical relationship between the radial position and the angle of rotation (circumferential position), a logarithmic spiral is defined by the following mathematical relationship:

$$r=B^{\theta}$$

wherein r is the radial position;

wherein B is a constant of proportionality; and wherein θ is the angle of rotation about a point or axis.

As may be appreciated, changing the respective constant of proportionality of an equation defining either an Archimedean spiral or a logarithmic spiral, respectively, may influence the relative "tightness" (i.e., the number of revolutions about the point or axis that the spiral revolves in relation to a given change in the radial position thereof) of a spiral path. The present invention encompasses spiral paths exhibiting relatively tight configuration, meaning a relatively high number of revolutions for a given change in radius (i.e., relatively high proportionality constants), relatively loose, meaning relatively low number of revolutions for a given change in radius (i.e., relatively low proportionality constants), as well as intermediate relationships between radial position and angle of rotation (circumferential position), without limitation.

While the above-referenced common mathematical definitions of spiral are provided as examples, they are not to be construed as limiting of the present invention. Rather, as mentioned above, the term "spiral," as used herein, refers to the path of a point that moves circumferentially around a central axis or center of revolution while generally radially receding from or preceding toward it. Therefore, it may be appreciated that a spiral path according to the present invention may take many forms, whether defined mathematically or otherwise defined.

It should further be noted that a spiral path of the present invention may lie, or be superimposed upon, a surface that is not planar. Particularly, a spiral path of the present invention may lie upon or be substantially coincident with a surface of a central region of an inverted cone region of a rotary drag bit. Although portions of the inverted cone region may be planar, typically, an inverted cone region of a rotary drag bit may be at least partially arcuate or at least partially conical in geometry.

Accordingly, turning back to FIG. 1C, where the inverted cone region 32 forms an at least partially conical surface, the spiral path 39 may be referred to as a helix, or helical in nature. However, more generally, a spiral path of the present invention may lie upon or be superimposed upon an arcuate surface or a surface having any topography. Thus, if the surface upon which a spiral path is superimposed varies longitudinally, the longitudinal position of the spiral path may vary in relation thereto. Of course, other characteristics of the spiral, such as the radial position, angle of rotation (circumferential position), or both, may influence the position thereof as superimposed upon a longitudinally varying surface.

In addition, now referring to FIG. 1D, spiral path 39 may encircle its center of revolution at least once. Optionally, spiral path 39 may encircle the longitudinal axis 11, which may or may not be coincident with the center of revolution, at least once. Such a configuration may be advantageous for providing cutting structure coverage of the central region 33 as the rotary drag bit 10 rotates about longitudinal axis 11. Explaining further, as a formation (not shown) enters central region 33 during drilling, the plurality of discrete cutting structures 30 may contact and drill the formation as known in the art. Further, central region 33 may also include an over-center pin 49, which is configured to engage and drill the formation into smaller pieces and may include a plurality of discrete cutting structures (not shown) arranged upon a substantially planar surface, the substantially planar surface disposed at an angle with respect to the longitudinal axis 11 of the rotary drag bit 10, as known in the art.

In another aspect of the present invention, the present invention contemplates that there may be at least one spiral path. Accordingly, the present invention may include only one spiral path upon which cutting structures may be disposed or, alternatively, may include two or more spiral paths upon which the cutting structures may be disposed. The centers of revolution of two or more spiral paths may be generally aligned with one another or may not be aligned with respect to one another.

Figure 1E:
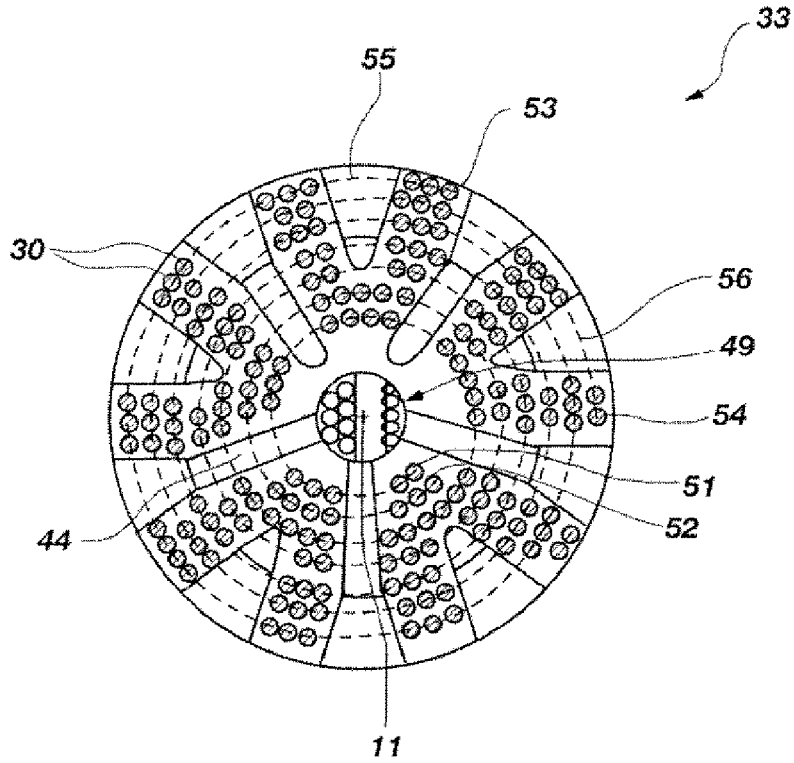
FIG. 1E is an enlarged top elevation view of an alternative embodiment of the central region shown in FIG. 1B.

For instance, FIG. 1E shows an alternative embodiment of central region 33 of rotary drag bit 10, which includes two spiral paths 55 and 56 upon which cutting structures 30 are disposed. Spiral paths 55 and 56 extend circumferentially about their respective centers of revolution, which are both generally aligned or substantially collinear with respect to longitudinal axis 11, in a clockwise circumferential direction, as shown in FIG. 1E, between beginning points 51 and 52 and end points 53 and 54, respectively.

It should be understood that different sizes and shapes of cutting structures may be positioned on spiral path 55, spiral path 56, or both spiral paths 55 and 56. In addition, it should be recognized from the foregoing discussion that many different configurations of spiral path arrangements or configurations are possible, depending on the relative size and shape of particular cutting structures employed and the configuration of the at least one spiral path upon which such cutting structures may be disposed.

Figure 1F:
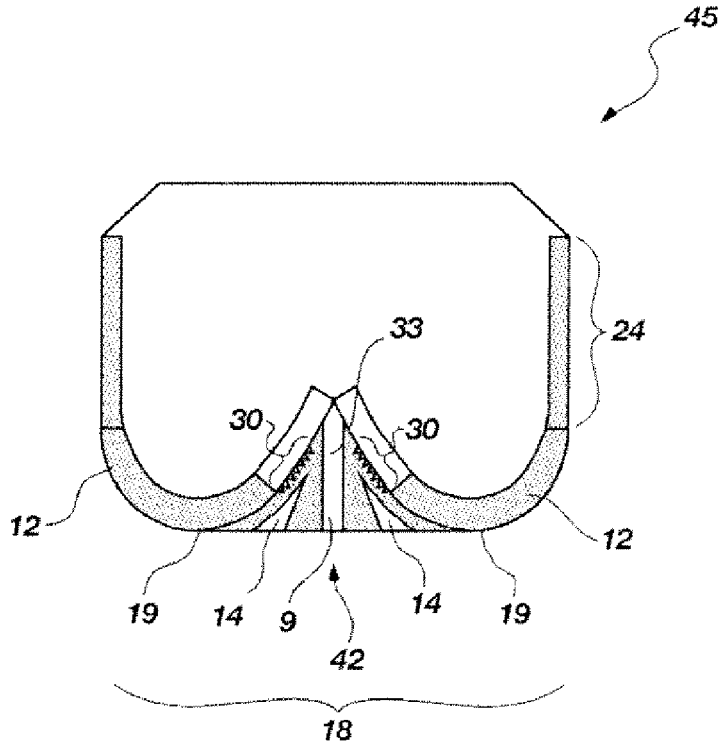
FIG. 1F is a partial side cross-sectional schematic view of an alternative embodiment of a crown of a rotary drag bit as shown in FIGS. 1A and 1B.

In addition, there are many alternative geometries that inverted cone region 32 and central region 33 may exhibit, For instance, FIG. 1F shows a partial cross-sectional schematic side view of an alternative embodiment of a crown 45 of rotary drag bit 10 of the present invention, wherein the crown 45 is oriented as it would be for drilling into a formation. In comparison to FIG. 1C, the central region 33 of crown 45 depicted in FIG. 1F is positioned more longitudinally toward the lowermost longitudinal extent 19 of blades 9 and blades 12 of rotary drag bit 10. Crown 45 may include gage regions 24, blades 9, blades 12, and inverted cone region 42. Inverted cone region 42 may be generally shaped as shown in FIG. 1F, as a generally conical indentation, which may preferably be substantially centered about the longitudinal axis 11. In addition, a plurality of cutting structures 30 may be arranged within inverted cone region 42 along a spiral path (not shown). Also, a spiral path may encircle its center of revolution at least once within the inverted cone region 42. In one embodiment, a spiral path may be substantially centered about longitudinal axis 11 and may encircle thereabout at least once within the inverted cone region 42.

The plurality of cutting structures 30 may be employed to drill the formation that encounters the central region 33. Further, central region 33 may also include an over-center pin 49 (FIG. 1E), which may be configured to cause a core or formation engaging same to be drilled into smaller pieces and may include a plurality of discrete cutting structures (not shown) arranged upon a substantially planar surface, the substantially planar surface disposed at an angle with respect to the longitudinal axis 11 of the rotary drag bit 10, as known in the art.

Figure 2A:
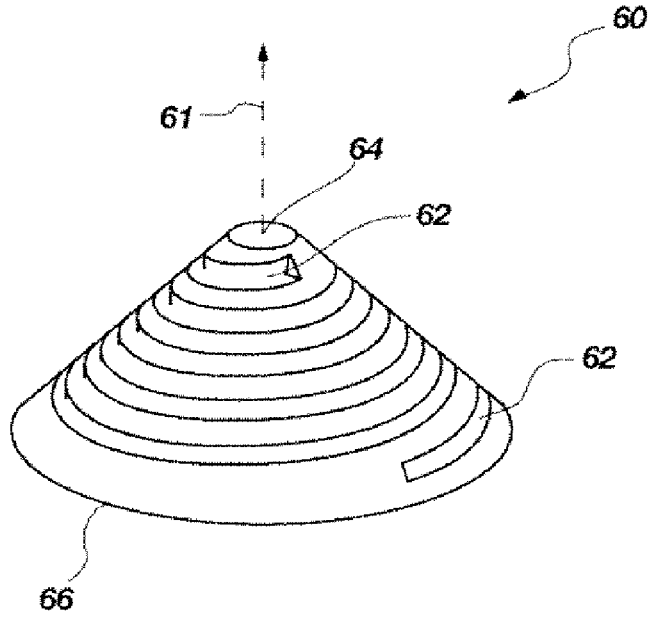
FIG. 2A is a perspective view of a cone region displacement according to the present invention.
Figure 2B:
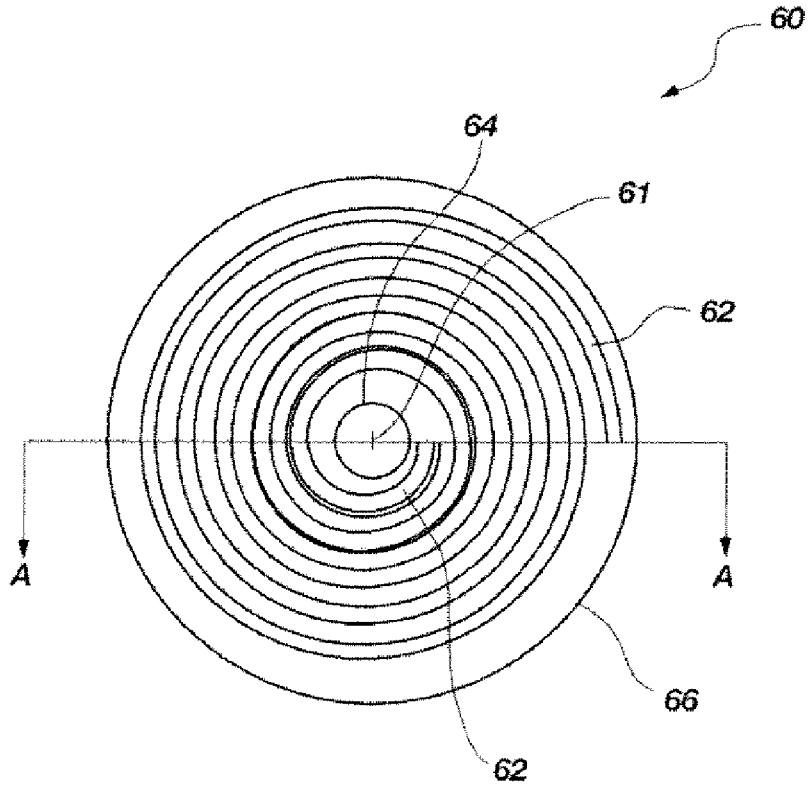
FIG. 2B is a top elevation view of the cone region displacement as shown in FIG. 2A.
Figure 2C:
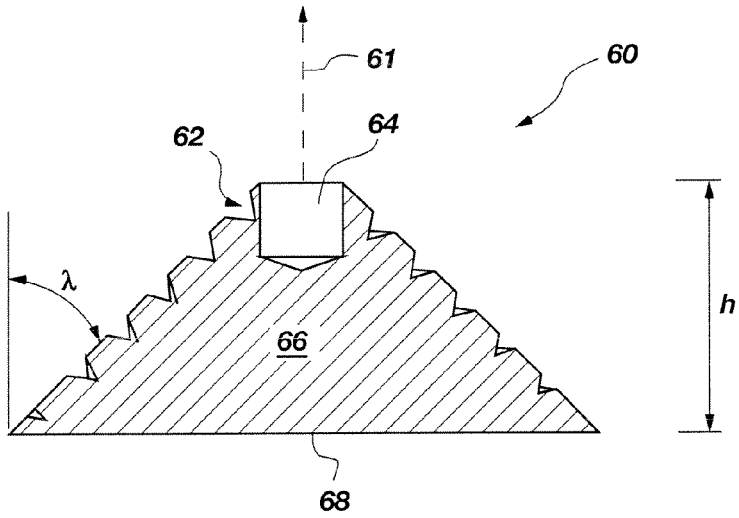
FIG. 2C is a side cross-sectional view of the cone region displacement shown in FIGS. 2A and 2B.

To further illustrate aspects of the present invention, a cone region displacement 60 for use in manufacturing an infiltrated rotary drag bit of the present invention is illustrated in FIGS. 2A, 2B, and 2C in perspective, top elevation, and side cross-sectional views, respectively. Generally, a cone region displacement 60 may exhibit an outer surface, which is sized and configured as exhibiting a generally complementary size and shape with respect to the desired inverted cone region of the rotary drag bit formed therewith.

For instance, cone region displacement 60 may comprise a frustoconical body 66 disposed about longitudinal axis 61 and within which groove 62 may be formed. As known in the art, cone region displacement 60 may comprise a graphite material or, alternatively, a ceramic material, such as a so-called castable ceramic. Groove 62 may follow a spiral path along the surface of frustoconical body 66; therefore, groove 62 may be helical. Further, groove 62 may follow a spiral path that encircles its center of revolution at least once upon the frustoconical body 66. Of course, the central axis of the frustoconical body 66 may be aligned with the center of revolution of the spiral path; hence, the groove 62 may be centered about the central axis of the cone region displacement 60.

Further, groove 62 may be sized and configured for accepting a plurality of similarly sized and configured or substantially identical cutting structures (not shown). Groove 62 may be configured to position a cutting structure disposed therein so that the cutting structure protrudes, after infiltration of a rotary drag bit, as described above, from a surface of the inverted cone region of the rotary drag bit formed therewith. Configuring individual cutting structures to protrude or exhibit exposure in relation to a surface of a rotary drag bit is well-known in the art and is commonly accomplished by forming a recess in a mold into which a cutting structure is at least partially disposed. For instance, groove 62 may be sized and configured to accept a plurality of natural diamonds, a plurality of synthetic diamonds, such as thermally stable synthetic diamonds. In addition, recess 64 may be formed in the upper end of frustoconical body 66 and may be sized and configured for accepting another displacement (not shown).

The geometry of frustoconical body 66 may be selected, as desired, for accommodating a range of rotary drag bit sizes. For instance, the cone angle, labeled λ in FIG. 2C may be selected as desired. For instance, cone angle λ may have a magnitude of about 45° or 60°, without limitation. Further, height, labeled "h" on FIG. 2C may be selected to be large enough to accommodate a range of different cone region displacement designs as discussed in more detail hereinbelow.

In addition, although the cone region displacement 60 is shown as comprising a frustoconical shape, the present invention is not so limited. As mentioned above, a central region of the present invention may comprise surfaces that are generally arcuate, substantially planar, partially hemispherical, generally conical, or as otherwise desired. Accordingly, since the cone region displacement 60 forms a portion of the surface of the central region of a rotary drag bit, the cone region displacement 60 may comprise surfaces which are generally arcuate, substantially planar, partially hemispherical, generally conical, or as otherwise desired. Preferably, however, the cone region displacement 60 may be substantially symmetric about longitudinal axis 61. Explaining further, the body of the cone region displacement 60 may comprise a "solid of revolution," which, as used herein, means a solid figure with an outer surface substantially defined by rotating a plane figure around an axis of revolution (e.g., longitudinal axis 61) that lies in the same plane. Furthermore, preferably, the longitudinal axis 61 of cone region displacement 60 may be substantially aligned with the longitudinal axis 11 (as shown in FIGS. 1A-1F) of the rotary drag bit formed therewith. Such a configuration may be preferable to promote substantial symmetry about the drilling axis of the rotary drag bit during drilling.

Figure 2D:
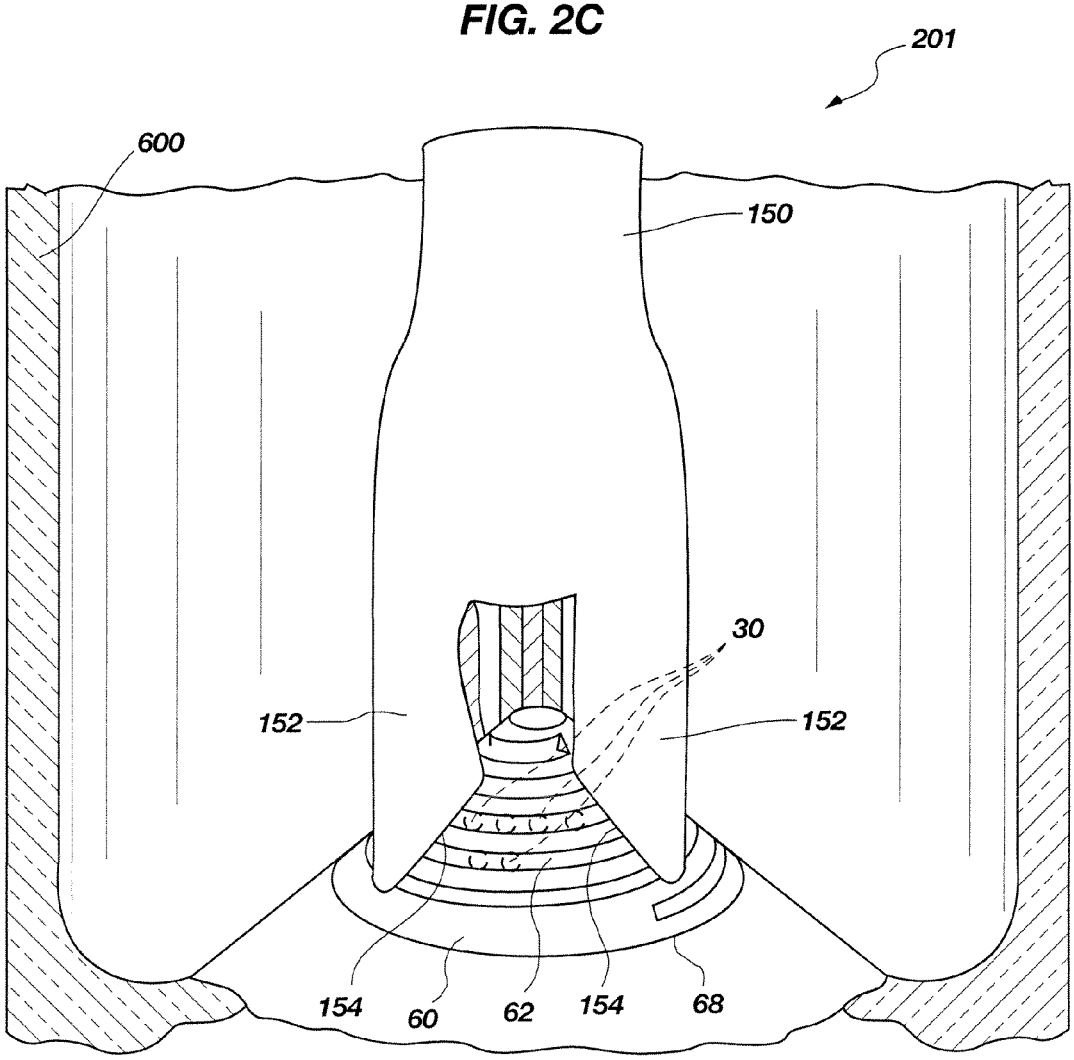
FIG. 2D is a perspective view of a fluid bore displacement assembled to the cone region displacement as shown in FIGS. 2A-2C, and disposed in a mold.

As mentioned above with respect to the manufacture of an infiltrated rotary drag bit, cone region displacement 60 may be placed within a mold (see, for example, FIG. 2D) for holding powder that may be infiltrated to form a rotary drag bit, as described hereinabove. In addition, as also shown in FIG. 2D, which shows assembly 201, a fluid bore displacement 150, otherwise known in the art as a "crow's foot," may be abutted against at least a portion of the cone region displacement 60 to form a portion of a mold 600, shown in partial section, for fabrication of an infiltrated rotary drag bit. Fluid bore displacement 150 may include one or more legs 152 that extend longitudinally downward therefrom and abut against at least a portion of a surface of cone region displacement 60 at overlap regions 154. As known in the art, legs 152 may be mated to cone region displacement 60 by way of clay that is disposed to form a seal for inhibiting molten infiltrant from flowing therebetween during infiltration.

Advantageously, since a spiral path may circumferentially encircle its center of revolution at least once, which may be preferable to substantially cover the drilling area of the central region, the overlap regions 154 need not be known beforehand and may not require custom modification of the cone region displacement 60 or the legs 152 of fluid bore displacement 150. Rather, fluid bore displacement 150 and cone region displacement 60 may be mated to one another and then cutting structures 30, only a few shown in broken lines for clarity, may simply be placed within those areas of groove 62, which do not form overlap regions 154. Thus, put another way, cutting structures 30 may be placed within portions of groove 62 which extend circumferentially between regions 154. Such a configuration may simplify the design of cone region displacement 60 and also provide flexibility in the alignment and design of cone region displacement 60 in relation to fluid bore displacement 150.

In contrast, a conventional cone region displacement design may include substantially radially extending grooves for placement of cutting structures. However, if the design of the fluid bore displacement 150 is changed or varies, overlap between intended placement of cutting structures therewith may preclude placement of cutting structures along at least a portion of a radially extending groove or even an entire radially extending groove thereon, which may either require altering the design of the fluid bore displacement 150 or altering the design of the conventional cone region displacement, because proper coverage of the central region of a rotary drag bit may be desirable to prevent excessive wear (i.e., ring-out) in a localized region of the rotary drag bit.

In addition, the cone region displacement 60, according to the present invention, may be easily modified to exhibit different sizes. For instance, height, labeled "h" of cone region displacement 60 may be altered by removing material from the lower longitudinal end 68 thereof. A portion of the groove 62 formed within the cone region displacement 60 may be removed as well. Thus, once a cone angle λ (FIG. 2C) is selected, a cone region displacement 60 having a height h (FIG. 2C) which is large enough to accommodate a range of bit sizes maybe formed. Subsequently, if it is desired to employ a cone region displacement 60 having a smaller height h, the initial height h may be reduced.

Reducing the initial height h which intersects with a portion of the groove 62 may cause formation of an open end of the groove 62 at the base of the cone region displacement 60. However, closure of an open end of the groove 62 may not be desired, because cutting structures 30 may simply be affixed within groove 62 by an adhesive. Alternatively, clay that is commonly used in rotary drag bit mold making, may be used to close the open end of groove 62 if so formed by removal of a portion of the lower longitudinal end 68 of the cone region displacement 60 (i.e., forming a new base surface). In a further alternative, placement within a mold (not shown) may close the open end of groove 62 if so formed by mating the lower end of cone region displacement 60 against an abutting surface of the mold.

Figure 3:
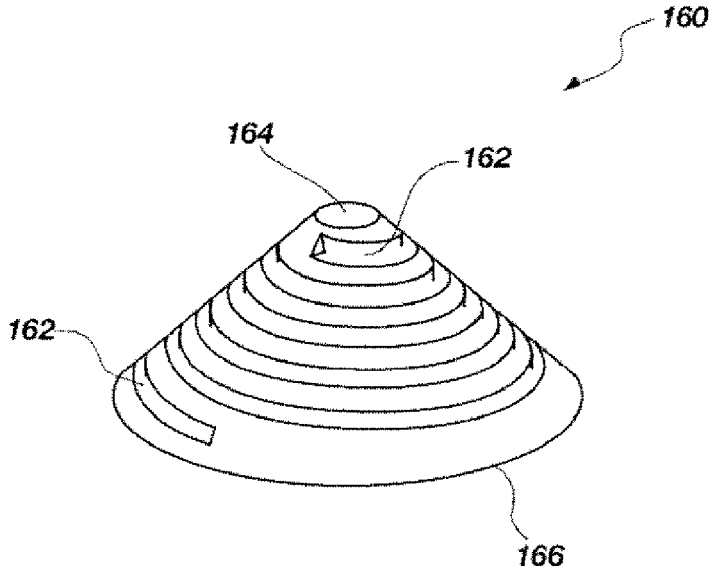
FIG. 3 is a perspective view of an alternative embodiment of a cone region displacement of the present invention.

In addition, the circumferential direction of a groove formed within a cone region displacement along a spiral path may be clockwise or counterclockwise in relation to a given fixed frame of reference, without limitation. Particularly, FIG. 3 shows a cone region displacement 160, which may comprise a frustoconical body 166 within which groove 162 may be formed. Groove 162 may follow a spiral path along the surface of frustoconical body 166. Groove 162 may be sized and configured for accepting a plurality of similarly configured and sized cutting structures (not shown). For instance, groove 162 may be sized and configured to accept a plurality of natural diamonds, a plurality of synthetic diamonds, such as thermally stable synthetic diamonds, or a combination thereof. Further, recess 164 may be formed in the upper end of frustoconical body 166 and may be sized and configured for accepting another displacement (not shown) sized and configured for forming an over-center pin, as discussed hereinabove.

In addition, different types of rotary drag bits may include a central region within an inverted cone region of the present invention. Particularly, rotary drag bits that include individual cutting structures that protrude from the blades thereof may include a central region within an inverted cone region of the present invention. For instance, BALLASET®-type rotary drag bits may include abrasive cutting structures protruding from the blades thereof. In addition, one or more polycrystalline diamond cutting elements may comprise at least a portion of the cutting structure of a rotary drag bit of the present invention, without limitation.

Figure 4A:
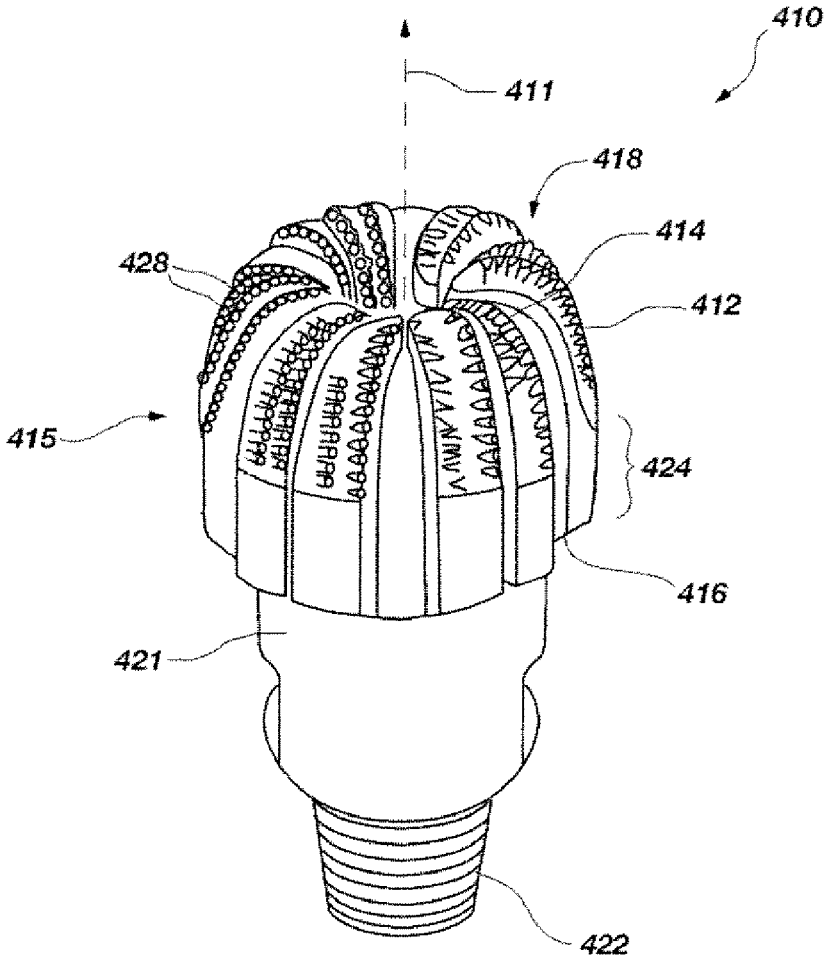
FIG. 4A is a perspective view of another embodiment of a rotary drag bit of the present invention.
Figure 4B:
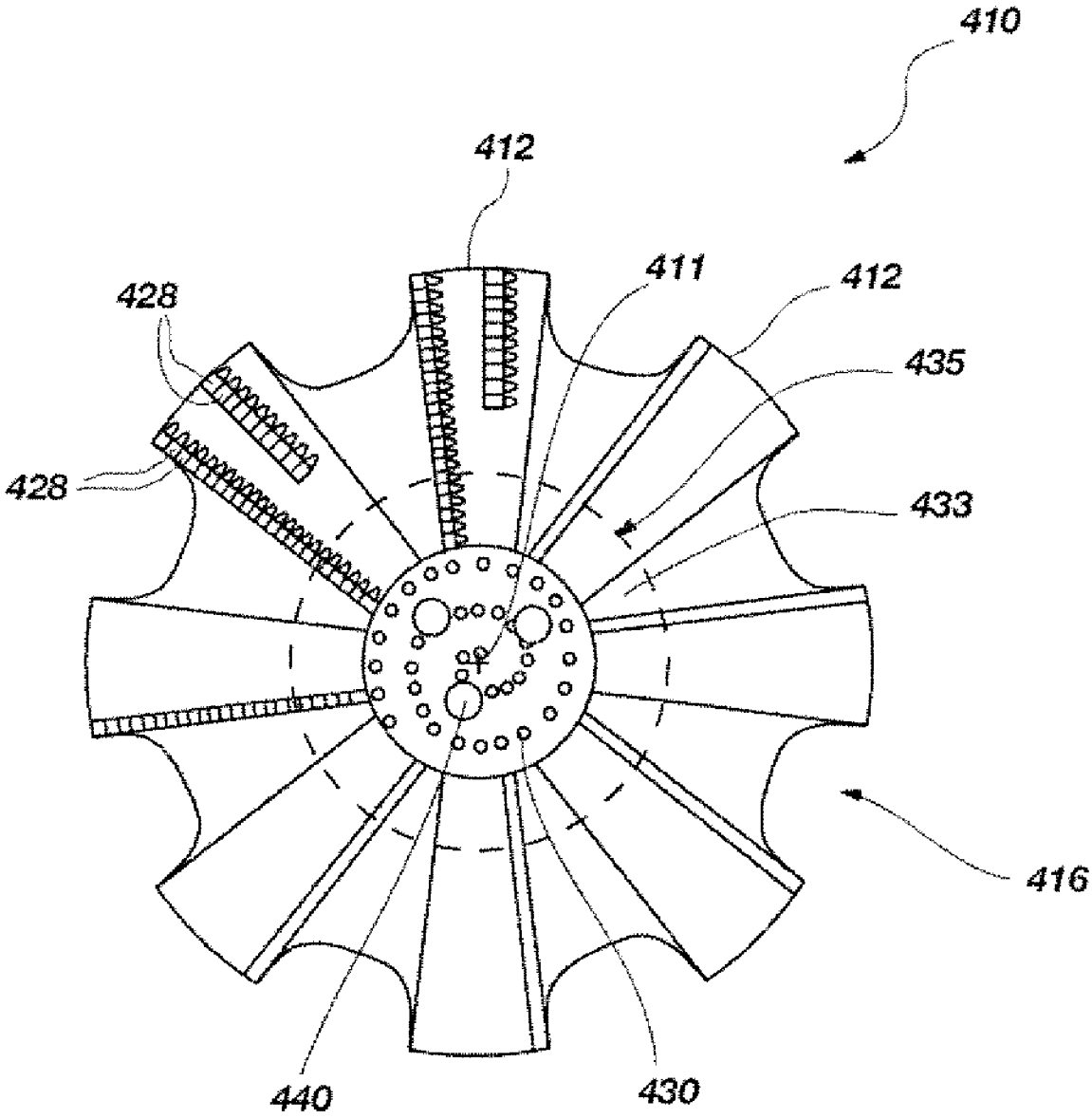
FIG. 4B is a top elevation view of the rotary drag bit as shown in FIG. 4A showing selected features thereon.

FIGS. 4A and 4B show, in a perspective side view and a top elevation view, respectively, rotary drag bit 410. Rotary drag bit 410 may include blades 412, which comprise at least one substantially radially extending row of thermally stable synthetic diamond cutting structures 428. As discussed above, during the manufacture of infiltrated rotary drag bits, thermally stable synthetic diamond cutting structures 428 may be infiltrated within the crown 415 of rotary drag bit 410.

Rotary drag bit 410 may include a threaded connection 422 forward on a shank 421 of the rotary drag bit 410 for connection to a drill string (not shown). Also, face 418 includes a plurality of blades 41, wherein each of the plurality of blades 412 extend generally radially outwardly with respect to longitudinal axis 411 to a gage region 424. In addition, fluid courses 414 extend to junk slots 416 formed between circumferentially adjacent blades 412. Accordingly, during operation, rotary drag bit 410 may be affixed to a drill string (not shown), rotated about longitudinal axis 411 and drilling into a subterranean formation as known in the art. Apertures 440 (FIG. 4B) may be configured to communicate drilling fluid from the interior of rotary drag hit 410 to the face 418 thereof, moving along fluid courses 414, into junk slots 416, and ultimately upwardly within the annulus formed between the drill string and a borehole formed by the rotary drag bit 410 during drilling.

Central region 433 is disposed within inverted cone region 435 of rotary drag bit 410 as shown in FIG. 4B and includes a plurality of cutting structures 430 disposed along a spiral path (not shown) that extends from proximate the longitudinal axis 411 radially outwardly, in a counter-clockwise circumferential direction. Central region 433 may comprise a plurality of cutting structures 430 disposed along at least one spiral path according to any of the above-described embodiments of the present invention.

Figure 5A:
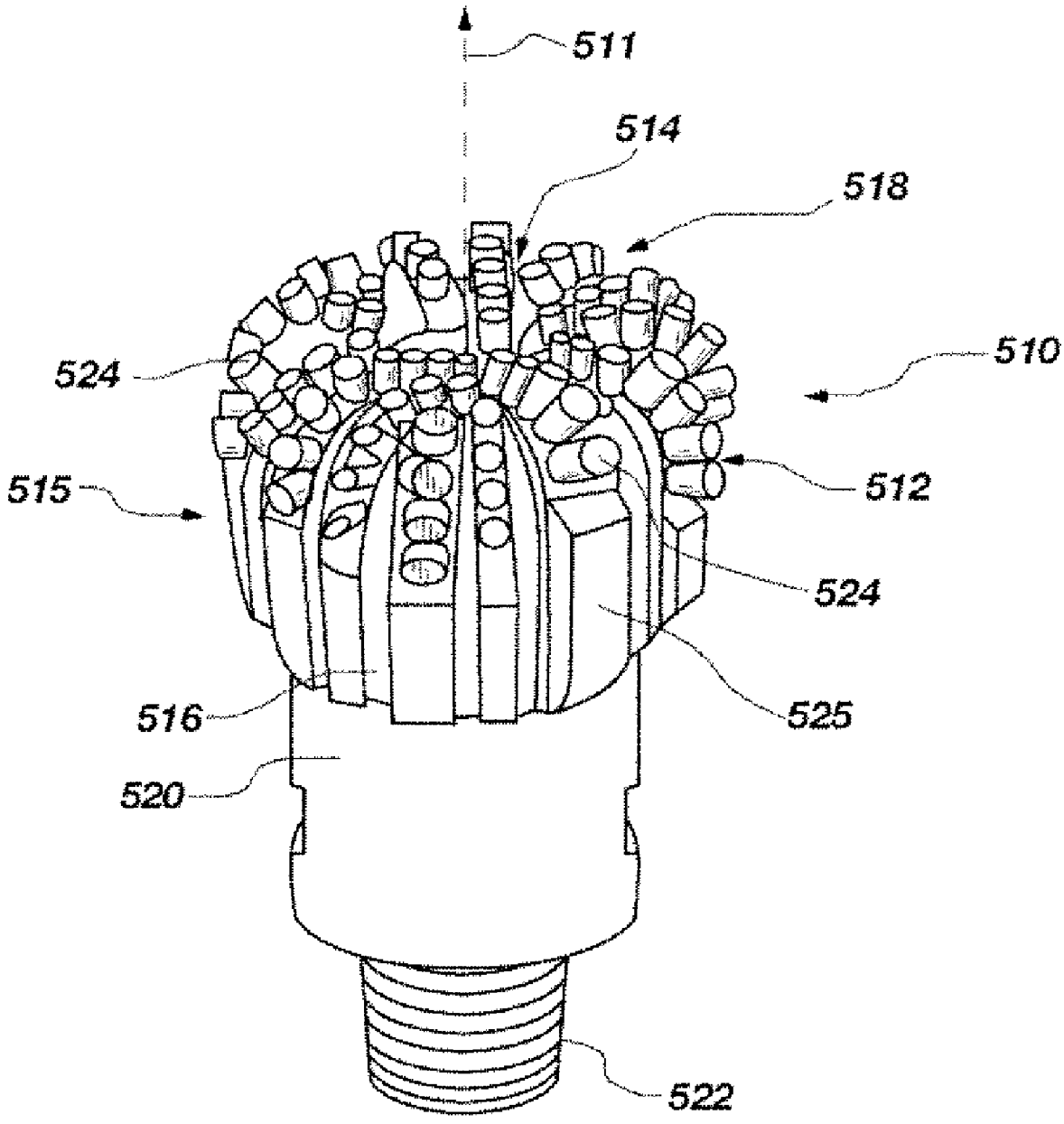
FIG. 5A is a perspective view of a rotary drag bit of the present invention including discrete cutting structures.
Figure 5B:
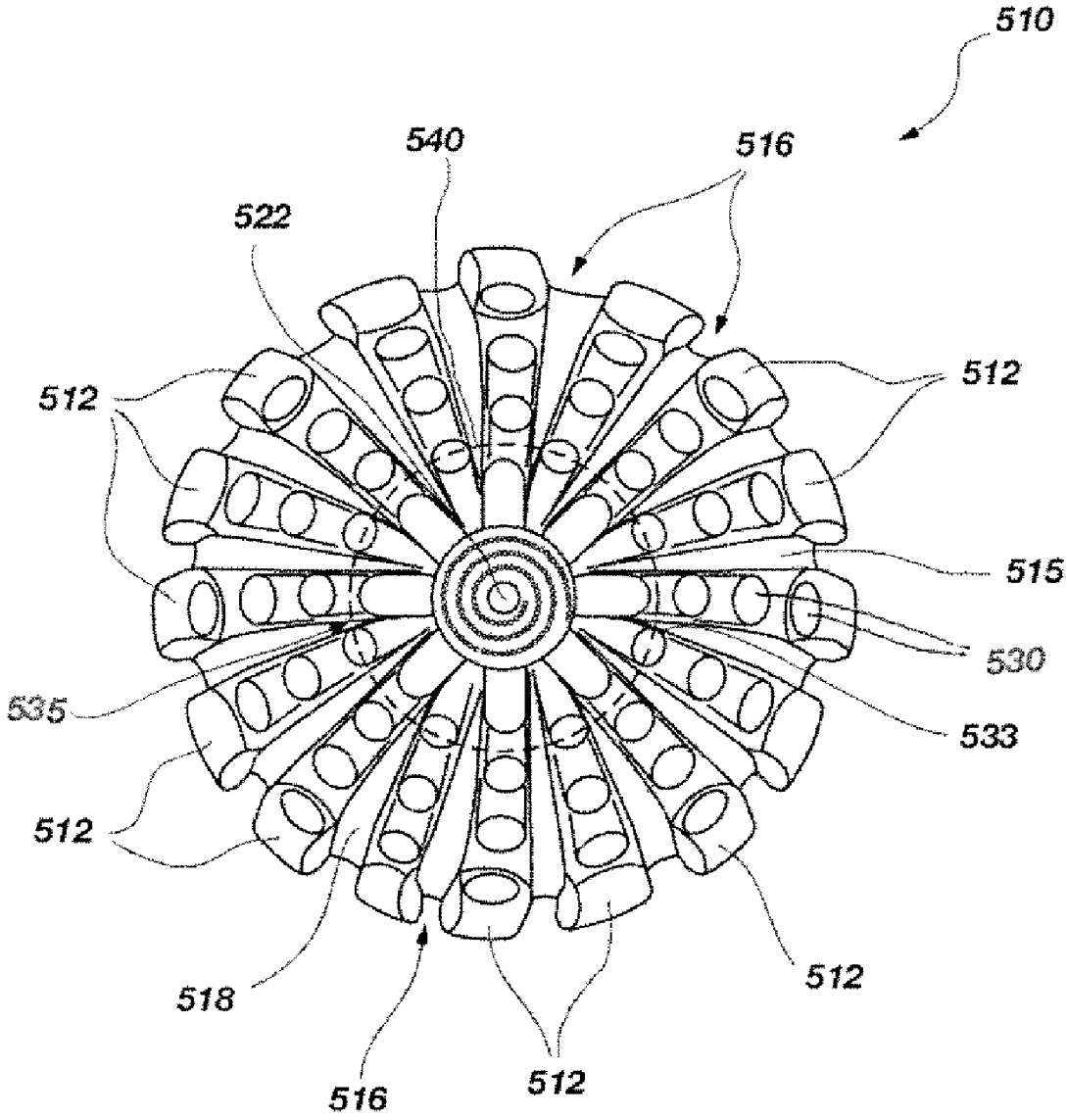
FIG. 5B is a top elevation view of the rotary drag bit as shown in FIG. 5A.

Another exemplary rotary drag bit that may employ the central region of the present invention may include discrete, post-like impregnated cutting structures as disclosed in U.S. Pat. No. 6,458,471 to Lovato and U.S. Pat. No. 6,510,906 to Richert, both of which are assigned to the assignee of the present invention and the disclosures of both of which are incorporated herein, in their entirety, by reference thereto. Accordingly, one example of an exemplary rotary drag bit 510 of the present invention, as shown in FIGS. 5A and 5B in a perspective side view and a top elevation view, respectively, may include discrete cutting structures 524, which are formed of impregnated material. Discrete cutting structures 524 may comprise a portion of rotary drag bit 510, may be formed as a portion of the rotary drag bit 510, as by infiltration therewith, or, alternatively, may be infiltrated, hot pressed, or otherwise fabricated separately and then affixed to the rotary drag bit 510 by brazing or press-fitting. Further, rotary drag bit 510 may include one or more polycrystalline diamond cutting elements (not shown) affixed thereto, without limitation.

Rotary drag bit 510 includes crown 515 for engaging a subterranean formation, a threaded connection 522 for connection to a drill string (not shown), and a bit body 520 therebetween. Face 518 may include a plurality of blades 519, wherein each of the plurality of blades 512 extends generally radially outwardly with respect to longitudinal axis 511 to a gage region 525. Blades 512, in this embodiment, however, refer to generally radially arranged groups of discrete cutting structures 524. Mole generally, discrete cutting structures 524 may be arranged in concentric or spiral fashion. Fluid courses 514 extend to junk slots 516 formed between circumferentially adjacent blades 512. Accordingly, during operation, rotary drag bit 510 may be affixed to a drill string (not shown), and drilled into a subterranean formation (not shown), as known in the art. Also, while drilling, drilling fluid may be communicated through central aperture 540 (FIG. 5B) from the interior of rotary drill bit 510 to the face 518 thereof, moving along fluid courses 514, into junk slots 516, and ultimately upwardly within the annulus formed between the drill string and a borehole formed by the rotary drag bit 510.

Central region 533 is disposed within inverted cone region 535 of rotary drag bit 510 as shown in FIG. 5B and includes a plurality of cutting structures 530 disposed along a spiral path (not shown) that extends, from proximate the longitudinal axis 511 (shown in FIG. 5A) radially outwardly in a counter-clockwise circumferential direction. Central region 533 may comprise a plurality of cutting structures 530 disposed along at least one spiral path according to any of the above-described embodiments of the present invention.

In addition, it should be recognized that further types of rotary drag bits may employ a central region of an inverted cone region of the present invention. For instance, while steel body rotary drag bits are not typically utilized in medium to hard abrasive subterranean formations, because infiltration provides a relatively higher diamond concentration than is economically viable with regard to a steel bit body manufacturing process, such steel body rotary drag bits may benefit from the present invention. In such a configuration, recesses may be machined along at least one spiral path for placement of cutting structures therein. Alternatively, a central region according to the present invention may be infiltrated and affixed to a steel body rotary drag bit by brazing, welding, or mechanical fasteners.

While the rotary drag bits of the present invention have been described with reference to certain exemplary embodiments, those of ordinary skill in the art will recognize and appreciate that it is not so limited. Additions, deletions and modifications to the embodiments illustrated and described herein may be made without departing from the scope of the invention as defined by the claims herein. Similarly, features from one embodiment may be combined with those of another.

What is claimed is:

1. A method of manufacture of a rotary drag bit, comprising:

providing a mold sized, shaped, and configured to define structural features of a rotary drag bit to be fabricated;

forming a cone region displacement comprising a generally frustoconical shaped body having a longitudinal axis;

forming at least one groove within the generally frustocinical shaped body of the cone region displacement, wherein the at least one groove is formed along at least one generally helical path in the direction of the longitudinal axis to encircle a center of revolution thereof at least once;

positioning the cone region displacement within the mold;

positioning a plurality of cutting structures along the at least one generally helical path within the at least one groove;

filling the mold with an infiltratable powder; and infiltrating the powder with a hardenable infiltrant.

2. The method of claim 1, further comprising mating a fluid bore displacement to at least a portion of a surface of the cone region displacement.

3. The method of claim 1, further comprising changing a dimension of the cone region displacement after the cone region displacement is formed.

4. The method of claim 3, wherein the action of changing the dimension of the cone region displacement comprises changing a height of the cone region displacement.

5. The method of claim 1, wherein the action of forming the at least one groove comprises forming the at least one groove along the at least one spiral path to encircle a longitudinal axis more than once.

6. The method of claim 5, wherein the action of forming the at least one groove comprises forming the at least one groove along the at least one spiral path extending from a beginning point proximate the longitudinal axis to an ending point radially distal from the longitudinal axis, in a clockwise circumferential direction.

7. The method of claim 1, wherein the action of forming the at least one groove comprises forming the at least one groove along at least one of an Archimedean spiral and a logarithmic spiral.

8. The method of claim 1, wherein the action of forming the at least one groove comprises forming a plurality of grooves, wherein each of the plurality of grooves is formed along a corresponding spiral path.

9. The method of claim 8, wherein the action of positioning the plurality of cutting structures comprises positioning a plurality of similarly configured and sized cutting structures within each of the plurality of grooves.

10. The method of claim 8, wherein the action of positioning the plurality of cutting structures within each of the plurality of grooves comprises positioning a plurality of similarly configured and sized cutting structures within each of the plurality of grooves.

11. The method of claim 1, wherein the action of positioning the plurality of cutting structures within the at least one groove comprises positioning a plurality of similarly configured and sized cutting structures within the at least one groove.

12. The method of claim 1, wherein the action of positioning the plurality of cutting structures within the at least one groove comprises positioning a plurality of similarly shaped cutting structures within the at least one groove.

* * * * *